United States Patent [19]

Breer, II

[11] 3,991,966

[45] Nov. 16, 1976

[54] PORTABLE DESK DEVICE

[76] Inventor: Carl Breer, II, 45 Preston Place, Grosse Point Farms, Mich. 48236

[22] Filed: Feb. 17, 1976

[21] Appl. No.: 658,248

Related U.S. Application Data

[63] Continuation-in-part of Ser. No. 569,069, April 17, 1975, abandoned.

[52] U.S. Cl. ..... 248/444; 108/43

[51] Int. Cl.[2] ..... A47B 97/04

[58] Field of Search ..... D6/138; 24/263 LS; 108/5, 6, 8, 28, 32, 43; 248/444, 451–454, 457, 371, 226 B, 226 D, 316 A, 316 C

[56] References Cited

UNITED STATES PATENTS

| | | | |
|---|---|---|---|
| 422,080 | 2/1890 | Hutton | 108/8 |
| 716,128 | 12/1902 | Stedeker | 248/444 |
| 891,091 | 8/1908 | Doeserich | 248/444 |
| 1,767,950 | 6/1930 | Westbrook | 248/454 |
| 1,770,955 | 7/1930 | Storm | 108/8 |
| 2,585,592 | 2/1952 | Sears | 248/291 |
| 2,701,173 | 2/1955 | Senior et al. | 108/43 |
| 2,986,366 | 5/1961 | Wesson | 248/316 A X |
| 3,215,453 | 11/1965 | Malcom | 108/43 X |
| 3,682,433 | 8/1972 | Petersen | 248/453 X |
| D139,017 | 10/1944 | Leatherman | 108/43 X |

FOREIGN PATENTS OR APPLICATIONS

| | | | |
|---|---|---|---|
| 731,149 | 2/1943 | Germany | 108/43 |
| 812,680 | 9/1951 | Germany | 108/43 |
| 1,461,685 | 9/1969 | Germany | 248/444 |
| 659,121 | 10/1951 | United Kingdom | 108/43 |
| 742,044 | 12/1955 | United Kingdom | 248/444 |
| 300,532 | 11/1928 | United Kingdom | 108/8 |

*Primary Examiner*—Lawrence J. Staab
*Attorney, Agent, or Firm*—Daniel Jay Tick

[57] ABSTRACT

A holder member for resting on a user's thigh comprises a plate-like thigh part bent at an obtuse angle for resting on a user's thigh and a plate-like support part extending from an edge of the thigh part at right angles therewith. A desk member for use by the user as a desk comprises a plate-like planar rest part and a plate-like mounting part extending from an edge of the rest part at right angles therewith. A fastening device adjustably movably affixes the desk member to the holder member for rotation of the mounting part of the desk member coplanar with the support part of the holder member about an axis perpendicular to the mounting part and support part and for movement of the rest part of the desk member relative to the thigh part of the holder member to vary the distance therebetween.

6 Claims, 8 Drawing Figures

PORTABLE DESK DEVICE

BACKGROUND OF THE INVENTION:

This is a Continuation-in-Part of application Ser. No. 569,069, filed Apr. 17, 1975 and now abandoned, for Portable Reading and Writing Device.

The present invention relates to a portable desk device.

It is quite often necessary for people to write and read under circumstances in which no desk or support surface is available. Writing or reading under these circumstances is extremely uncomfortable.

The principle object of the invention is to provide a portable desk device for providing comfort in writing and reading in the absence of a desk.

An object of the invention is to provide a portable desk device of simple structure, which is inexpensive in manufacture and is used with facility and convenience by anyone.

Another object of the invention is to provide a portable desk device which is light in weight, carried with facility and convenience and stores with facility and convenience in a small area.

Still another object of the invention is to provide a portable desk device which is assembled and properly adjusted for comfortable writing and reading rapidly and with great facility.

Yet another object of the invention is to provide a portable desk device of simple structure, which is readily adjustable to desired positions, rests on the thigh of the user and provides a comfortable and convenient desk surface to enable ease of writing and reading.

Another object of the invention is to provide a portable desk device which is supported by the thigh of the user in a manner which enables supporting a book or writing material without strain and thereby relieving muscle tension occurring when writing material or a book is held in another manner.

Still another object of the invention is to provide a portable desk device which functions as a rigid desk surface in any circumstances in which the user is able to sit or crouch.

Yet another object of the invention is to provide a portable desk device having a desk surface which is adjustable in angle relative to a horizontal plane and in height above the supporting thigh of the user.

Another object of the invention is to provide a portable desk device of simple, compact and sturdy structure, which functions efficiently, effectively and reliably to provide a reading and writing desk surface anywhere the user goes.

BRIEF SUMMARY OF THE INVENTION:

In accordance with the invention, a portable desk device comprises a holder member for resting on a user's thigh. The holder member comprises a substantially plate-like thigh part having a pair of spaced opposite major surfaces and an edge. The thigh part is bent at an obtuse angle for resting on a user's thigh. A substantially plate-like support part extends from the edge of the thigh part at substantially right angles therewith. The support part extends from the opposite surface of the thigh member from that having the angle formed therein. A desk member for use by the user as a desk comprises a substantially plate-like substantially planar rest part having a pair of spaced opposite major surfaces and an edge. A substantially plate-like mounting part extends from the edge of the rest part at substantially right angles therewith. The mounting part extends from the opposite surface of the rest part from that used as a desk surface. A fastening device adjustably movably affixes the desk member to the holder member for rotation of the mounting part of the desk member substantially coplanar with the support part of the holder member about an axis substantially perpendicular to the mounting part and the support part and for movement of the rest part of the desk member relative to the thigh part of the holder member to vary the distance therebetween.

The fastening means comprises a bore formed through the support part of the holder member. A slot is formed through the mounting part of the desk member and extends substantially perpendicularly to the plane of the rest part of the desk member. A bolt device extending through the bore and the slot adjustably releasably affixes the desk member to the holder member.

The rest part of the desk member is bent at an obtuse angle for supporting an open book on its desk surface.

A pad of substantially elastic material having a substantially high coefficient of friction is affixed to the surface of the thigh part of the holder member opposite that from which the support part extends for maintaining the holder member in position on the user's thigh.

Each of the support part of the holder member and the mounting part of the desk member has a pair of spaced opposite major surfaces. A layer of material having a substantially high coefficient of friction is affixed to the surface of the support part facing the mounting part.

A clamp device is slidably mounted on the rest part of the desk member for releasably clamping items to the surface of the rest part opposite that from which the mounting part extends.

BRIEF DESCRIPTION OF THE DRAWINGS:

In order that the invention may be readily carried into effect, it will now be described with reference to the accompanying drawings, wherein.

In the FIGS., the same components are identified by the same reference numerals.

Figure 4:
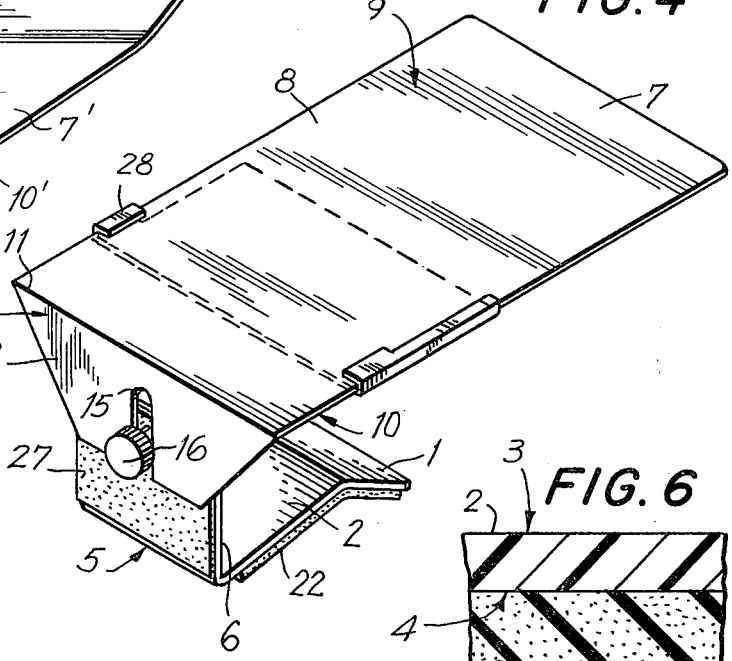
FIG. 4 is a perspective view of the embodiment of FIG. 1, taken from another angle.
Figure 6:
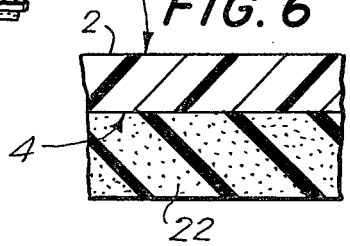
FIG. 6 is a cross-sectional view, on an enlarged scale, of part of the thigh part of the holder member of the portable desk device of the invention.

DETAILED DESCRIPTION OF THE INVENTION:

The portable desk device of the invention comprises a holder member 1 (FIGS. 1, 2 and 4) for resting on a user's thigh. The holder member 1 comprises a substantially plate-like thigh part 2 having a pair of spaced opposite major surfaces 3 and 4 (FIG. 6) and an edge 5 (FIG. 4). The thigh part 2 is bent at an obtuse angle A (FIGS. 1 and 2) for resting on a user's thigh. The angle A is preferably in the range of 120° to 160° and, in a preferred embodiment of the invention, is 150°.

A substantially plate-like support part 6 (FIGS. 1, 2 and 4) extends from the edge 5 of the thigh part at substantially right angles therewith. The support part 6 extends from the opposite surface of the thigh member 2 from that having the angle formed therein. That is, the support part 6 extends from the surface 3 of the thigh member 2 whereas the obtuse angle A is formed in the surface 4 thereof.

A desk member 7 (FIGS. 1 and 4) or 7' (FIG. 3) is used by the user as a desk. The desk member 7 comprises a substantially plate-like substantially planar rest part 8 having a pair of spaced opposite major surfaces 9 and 10 and an edge 11 (FIG. 4).

Figure 1:
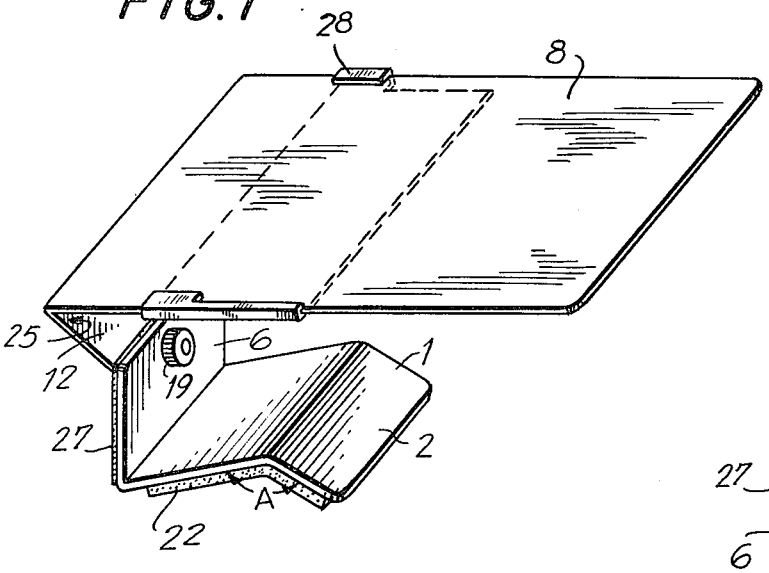
FIG. 1 is a perspective view of an embodiment of the portable desk device of the invention.
Figure 2:
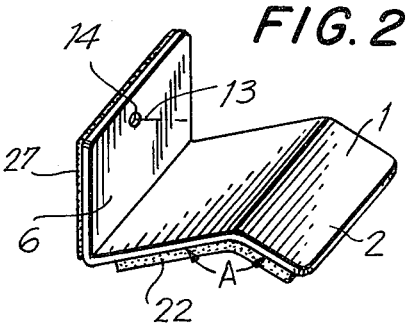
FIG. 2 is a perspective view of an embodiment of the holder member of the portable desk device of the invention.

A substantially plate-like mounting part 12 extends from the edge 11 of the rest part 8 at substantially right angles therewith (FIGS. 1 and 4). The mounting part 12 extends from the opposite surface of the rest part 8 from that used as the desk surface. Thus, the mounting part 12 extends from the surface 10, which is opposite the desk surface 9.

Figure 3:
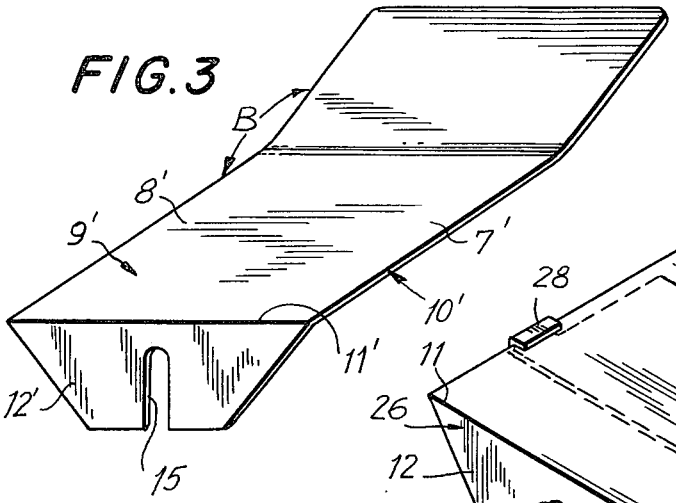
FIG. 3 is a perspective view of another embodiment of the desk member of the portable desk device of the invention.

The desk member 7' of the embodiment of FIG. 3 is identical to the desk member 7 of the embodiment of FIGS. 1 and 4, except that in the embodiment of FIG. 3, said rest part is bent at an obtuse angle B (FIG. 3) for supporting an open book on its desk surface 9'. The angle B may have any value in the range of 120° to 160°, and is preferably 150°.

A fastening device adjustably movably affixes the desk member 7 to the holder member 1 for rotation of the mounting part 12 or 12' of the desk member substantially coplanar with the support part 6 of the holder member about the axis 13 (FIG. 2) substantially perpendicular to said mounting part and said support part, and for movement of the rest part 8 or 8' of the desk member relative to the thigh part 2 of the holder member to vary the distance therebetween.

The fastening device comprises a bore 14 (FIG. 2) formed through the support part 6 of the holder member 1. A slot 15 (FIG. 4) or 15' (FIG. 3) is formed through the mounting part 12 or 12', respectively, of the desk member 7 or 7', respectively. The slot 15 or 15' extends substantially perpendicular to the plane of the rest part 8 or 8' of the desk member 7 or 7', respectively. The fastening device includes a bolt device 16 (FIGS. 1, 4 and 8) extending through the bore 14 and the slot 15 for adjustably releasably affixing the desk member to the holder member.

Figure 8:
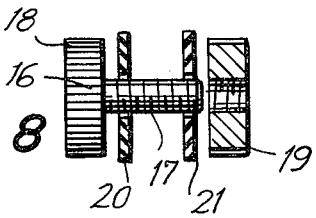
FIG. 8 is a cross-sectional view of a bolt device of the fastening device of the portable desk device of the invention.

As shown in FIG. 8, the bolt device comprises a bolt 17 having a knurled head 18 to facilitate manual rotation thereof. The bolt 17 is secured in the bore 14 and slot 15 by a nut 19. In order to suitably position the bolt 17 in the slot 15 or 15' and to prevent slippage, a pair of rubber washers 20 and 21 are provided on the bolt; the washer 20 being positioned next-adjacent the nut 19.

A pad of substantially elastic material 22 (FIGS. 1, 2, 4 and 6) having a substantially high coefficient of friction is affixed to the surface 4 of the thigh part 2 of the bolder member 1 for maintaining said holder member in position on the user's thigh. The material 22 may comprise any suitable material for serving the intended purpose such as, for example, foam rubber. The foam rubber pad 22 serves not only to maintain the holder member 1 in position on the user's thigh, but provides comfort to the user by cushioning the weight of a book or the like supported on the desk member 7.

Figure 7:
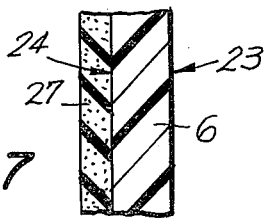
FIG. 7 is a cross-sectional view, on an enlarged scale, of part of the support part of the holder member of the portable desk device of the invention.

The support part 6 of the holder member has a pair of spaced opposite major surfaces 23 and 24, as shown in FIG. 7. The mounting part 12 of the desk member 7 has a pair of spaced opposite major surfaces 25, shown in FIG. 1, and 26, shown in FIG. 4. A layer of material 27 (FIGS. 1, 2 and 7) having a substantially high coefficient of friction, is affixed to the surface 24 of the support part 6 facing the mounting part 12. The layer 27 serves to increase the friction between the holder member and the desk member to prevent undesired slippage of the desk member relative to the holder member and may comprise any suitable material for accomplishing this purpose such as, for example, rubber.

Figure 5:
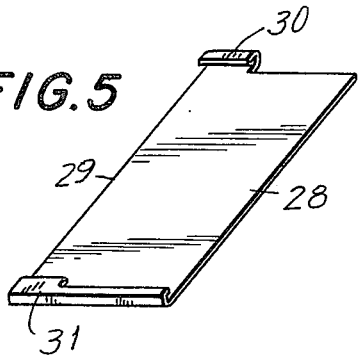
FIG. 5 is a perspective view of an embodiment of the fastening device of the portable desk device of the invention.

As shown in FIGS. 1, 4 and 5, a clamp device 28 is slidably mounted on the rest part 8 of the desk member 7 for releasably clamping items such as, for example, paper, books, and the like, to the surface 9 of said rest part. The clamp device 28 comprises a plate-like member 29, as shown in FIG. 5, which extends across the surface 10 of the rest part 8 of the desk member 7 and is bent at its opposite ends into resilient parts 30 and 31 which fold over the opposite edges of said rest part and function as clamps on the surface 9 as well as providing a channel which permits the clamp device to slide along said rest part. A writing implement such as, for example, a pencil or a pen, is releasably supported by the resilient part 31. The member 29 preferably comprises spring-type steel or the like.

The portable desk device of the invention is used by placing the thigh part 2 of the holder member 1 on the thigh of the user. The user then uses the bolt device 16 to adjust the distance between the rest part 8 of the desk member 7 and the thigh part 2 of the holder member 1 and to adjust the angle of inclination of said rest part relative to said thigh part. This provides the user with maximum comfort in the use of the portable device of the invention.

The portable desk device of the invention is especially versatile in that it may be used with equal facility and comfort by righthanded or lefthanded people, alike.

While the invention has been described by means of specific examples and in specific embodiments, I do not wish to be limited thereto, for obvious modifications will occur to those skilled in the art without departing from the spirit and scope of the invention.

I claim:

1. A portable desk device, comprising a holder member for resting on a user's thigh, said holder member comprising a substantially plate-like thigh part having a pair of spaced opposite major surfaces and an edge, said thigh part being bent at an obtuse angle to form an angular surface portion of between 120° and 160° for resting on a user's thigh, and a substantially plate-like support part extending from the edge of the thigh part at substantially right angles therewith, said support part extending from the opposite surface of said thigh part from that having the angular surface portion;

a desk member for use by the user as a desk, said desk member comprising a substantially plate-like rest part having a pair of spaced opposite major surfaces and an edge, and a substantially plate-like mounting part extending from the edge of the rest part at substantially right angles therewith, said mounting part extending from the opposite surface of said rest part from that used as a desk surface; and fastening means adjustably movably affixing the desk member to the holder member for rotation of the mounting part of the desk member substantially coplanar with the support part of the holder member about an axis substantially perpendicular to said mounting part and said support port and for movement of the rest part of the desk member relative to the thigh part of the holder member to vary the distance therebetween, the rest part of said desk member being supported in cantilevered fashion by said mounting part and overlying the thigh part of said holder member.

2. A portable desk device as claimed in claim 1, wherein the fastening means comprises a bore formed through the support part of the holder member, a slot formed through the mounting part of the desk member and extending substantially perpendicularly to the plane of the rest part of the desk member and a bolt device extending through the bore and the slot for adjustably releasably affixing the desk member to the holder member.

3. A portable desk device as claimed in claim 1, wherein the rest part of the desk member is bent at an obtuse angle for supporting an open book on its desk surface.

4. A portable desk device as claimed in claim 1, further comprising a pad of substantially elastic material having a substantially high coefficient of friction affixed to the surface of the thigh part of the holder member opposite that from which the support part extends for maintaining the holder member in position on the user's thigh.

5. A portable desk device as claimed in claim 1, wherein each of the support part of the holder member and the mounting part of the desk member has a pair of spaced opposite major surfaces, and further comprising a layer of material having a substantially high coefficient of the friction affixed to the surface of the support part facing the mounting part.

6. A portable desk device as claimed in claim 1, further comprising clamp means slidably mounted on the rest part of the desk member for releasably clamping items to the surface of the rest part opposite that from which the mounting part extends.

* * * * *